US007644641B2

(12) United States Patent
Mototani et al.

(10) Patent No.: US 7,644,641 B2
(45) Date of Patent: Jan. 12, 2010

(54) OPERATING LEVER DEVICE

(75) Inventors: Masayoshi Mototani, Tochigi (JP); Shuuji Hori, Tochigi (JP); Daisuke Kozuka, Tochigi (JP); Yasuhiro Sato, Tochigi (JP); Koichi Miyake, Tochigi (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 571 days.

(21) Appl. No.: 10/573,055

(22) PCT Filed: Sep. 22, 2004

(86) PCT No.: PCT/JP2004/013816

§ 371 (c)(1),
(2), (4) Date: Mar. 22, 2006

(87) PCT Pub. No.: WO2005/033823

PCT Pub. Date: Apr. 14, 2005

(65) Prior Publication Data

US 2007/0137402 A1 Jun. 21, 2007

(30) Foreign Application Priority Data

Sep. 30, 2003 (JP) ..... 2003-339734

(51) Int. Cl.
*G05G 1/04* (2006.01)

(52) U.S. Cl. ..... 74/519

(58) Field of Classification Search ..... 74/491, 74/504, 510, 519; 37/347
See application file for complete search history.

(56) References Cited

FOREIGN PATENT DOCUMENTS

| | | | |
|---|---|---|---|
| JP | 4-50064 A | | 2/1992 |
| JP | 5-58997 A | | 8/1993 |
| JP | 07091407 A | * | 4/1995 |
| JP | 7-301271 A | | 11/1995 |
| JP | 8-49743 A | | 2/1996 |
| JP | 8-49744 A | | 2/1996 |
| JP | 1-265455 A | | 9/2001 |

* cited by examiner

*Primary Examiner*—Vicky A Johnson
(74) *Attorney, Agent, or Firm*—Fish & Richardson P.C.

(57) ABSTRACT

A rotor and a seat mounted on a first shell is disposed between an annular first shell and an annular second shell both constituting a damper case, thereby forming a rotary damper device. A damper lever on which the rotor is mounted is hooked on a fixing pin fixed to a body. Viscous fluid such as highly viscous oil is charged into a damper chamber formed between the rotor and the seat, and a viscous resistance is applied to the rotor and the seat. In a state in which a rotation center of the rotary damper device is deviated from a rotation center of the shaft which is rotated by the operating lever, the damper case is fixed to a flange portion of the shaft, the rotor and the seat are allowed to rotate relatively to each other by an inclining operation of the operating lever, and a resistance force from the rotary damper device is applied to the operating lever.

4 Claims, 10 Drawing Sheets

OPERATING LEVER DEVICE

TECHNICAL FIELD

The present invention relates to an operating lever device which is suitable for switching and operating a direction-switching valve and the like disposed in an oil hydraulic circuit used for, for example, construction equipment and industrial equipment.

BACKGROUND ART

Generally, in the construction equipment or the industrial equipment, a hydraulic cylinder and the like used for operation are disposed, in addition, hydraulic motors are disposed on left and right sides of a lower running body, and the hydraulic motors are used as driving motors. According to the driving motor, pressurized oil is supplied from an oil pressure source or pressurized oil from the driving motor is discharged by controlling a driving direction-control valve. With this configuration, it is possible to control the running state of the lower running body on a road.

The construction machinery or the industrial machinery is provided with a cab for defining a driver's room in a frame on the lower running body, and an operating lever device for running is provided on a floor of the cab. If an operator inclines an operating lever for running back and forth, the switching of a running direction-control valve is controlled, and a rotation direction and a rotation speed of the driving motor are controlled. The speed of a vehicle running forward and backward and turning motion of the vehicle can be controlled in accordance with an inclining operation amount of the operating lever.

Such an operating lever device is provided with damper means which generates a resistance force at the time of inclination operation of the operating lever so as to enhance the operator's operation feeling. An operating lever device (see patent document 1 for example) using a rotary damper means is proposed as the damper means.

In the operating lever device described in the patent document 1, as shown in FIG. 10, rotary dampers 52 are inserted through projecting ends of turning shafts 51 projecting from a lever holder 50, and damper cases 53 of the inserted rotary dampers 52 are fixed to the lever holder 50. The rotary damper 52 is disposed between a side surface of the lever holder 50 and a bracket portion 54*b* of the operating lever 54. An annular damper chamber is defined in the damper case 53. Viscous fluid such as highly viscous oil is accommodated in the damper chamber, and a rotor 55 which is rotated against the viscous fluid is provided in each damper chamber.

Operating transmission lever 56 for transmitting the inclining operation amount of the operating levers 54 to the rotors 55 are provided between the rotors 55 of the rotary dampers 52 and the operating levers 54. If the turning shafts 51 are rotated by inclining operation of the operating levers 54, the rotors 55 also rotate in the same direction. The damper cases 53 are fixed to the lever holder 50, so the damper cases 53 do not rotate even if the operating levers 54 are inclined.

With this configuration, if the turning shafts 51 are rotated by inclining operation of the operating levers 54, the rotors 55 of the rotary dampers 52 together with the turning shaft 51 in unison against the viscous fluid in the damper chambers. With this, a resistance force caused by the viscous fluid is transmitted to the operating levers 54 as a reaction force, and an operator can obtain excellent operation feeling.

In the operating lever device described in the patent document 1, the rotors 55 are provided concentrically with the rotation shafts 51. That is, the inclining operation amount of the operating lever 54 and the rotation amount of the rotor 55 have a one-one relation. Thus, even if the rotor 55 is rotated as the operating lever 54 is inclined, only an intrinsic resistance force of the rotary damper 52 generated between the viscous fluid and the rotor 55 is received by the operating lever 54, and a resistance force received by the operating lever 54 can not be varied.

Due to this configuration, it is not possible to adjust the resistance force from the rotary damper 52 with respect to the inclining operation of the operating lever 54 in accordance with sensibility of the operator. In order to change the resistance force of the rotary damper 52 in accordance with the sensibility of the operator, it is necessary to prepare a plurality of rotary dampers having different resistance forces, and to selectively dispose the rotary dampers having a resistance force required by the operator. Even in this case, the rotary dampers must be replaced after the operating lever is detached, and the replacement operation can not be carried out easily. It is also difficult to select one of the plurality of rotary dampers that is most suitable for the operator's sensibility.

Patent document 1: Japanese Patent Laid-open Publication No. 2001-265455

DISCLOSURE OF THE INVENTION

Problem to be Solved by the Invention

The present invention has been accomplished to solve above described conventional problems, and it is an object of the invention to provide an operating lever device capable of easily obtaining a resistance force suitable for an operator's sensibility from disposed rotary dampers.

Means for Solving Problem

The object of the present invention can be achieved by the inventions described in claims 1 to 4.

That is, in the invention as described in claim 1, in an operating lever device comprising shafts which are rotated in unison with each other by inclining operation of an operating lever, a shaft support body which rotatably supports the shafts, and rotary damper means which generates rotation resistance at the time of the inclining operation of the operating lever, the operating lever device is most mainly characterized in that each rotary damper means includes a damper case having an annular damper chamber for accommodating viscous fluid therein, a rotor which rotates against the viscous fluid in the damper chamber, a fixing pin mounted on a body of the operating lever device, and a damper lever fixed to one of the damper case and the rotor, and a rotation center of the rotary damper means and a rotation center of each shaft are deviated from each other, the other of the damper case and the rotor is mounted on the shaft, and the damper lever is hooked on the fixing pin.

Further, the operating lever device is most characterized in that a hooking position between the fixing pin and the damper lever can be adjusted, the operating lever device further comprises an adjusting mechanism which adjusts a ratio between a distance from the rotation center of the shaft to the fixing pin, and a distance from the rotation center of the rotary damper means to the fixing pin, and the adjusting mechanism is formed on an upper portion of a floor on which the shaft support body is mounted.

Effect of the Invention

According to the present invention, the rotation center of the rotary damper means which applies the resistance force to the operating lever at the time of the inclining operation of the operating lever is deviated from the rotation center of the shaft. With this configuration, the resistance force of the rotary damper means to the operating lever can be increased or reduced by proportionating a value obtained by dividing a distance from the rotation center of the shaft to the fixing pin by a distance from the rotation center of the rotary damper means to the fixing pin.

Even if the same rotary damper means are used, the mounting position of the rotary damper means on the shaft can be changed, and the resistance force to be applied from the rotary damper means to the operating lever can be increased or reduced.

According to the present invention, by deviating the rotation center of the rotary damper means from the rotation center of the shaft, a greater resistance force or a smaller resistance force as compared with the conventional rotary damper can be applied to the operating lever. By changing the mounting position of the rotary damper means with respect to the shaft, the ratio of deviating the rotation center of the rotary damper means from the rotation center of the shaft can be changed, and the resistance force to be applied from the rotary damper means to the operating lever can variably be adjusted. With this configuration, a resistance force suitable for the sensibility of an operator can freely be adjusted by changing the mounting position of the rotary damper means with respect to the shaft.

The hooking position between the fixing pin and the damper lever can be adjusted. By changing the hooking position, the distance from the rotation center of the shaft to the fixing pin and the distance from the rotation center of the rotary damper means to the fixing pin can be changed, a value obtained by dividing a distance from the rotation center of the shaft to the fixing pin by a distance from the rotation center of the rotary damper means to the fixing pin can be changed. With this, the resistance force of the rotary damper means against the operating lever can be increased or reduced.

The fixing pin can be disposed on any position around the rotation shaft of the shaft. A freedom degree of design for disposing the rotary damper means of the operating lever device can be enhanced.

The operating lever may be mounted on the shaft, or the shaft and the operating lever may be integrally formed together. Thus, the shaft support body also has a function as a lever support body which rotatably supports the operating lever.

The adjusting mechanism which increases or reduces a resistance force to be applied from the rotary damper means to the operating lever can be formed on a fixing member which fixes the rotary damper means to the shaft or the operating lever formed on the shaft. The adjusting mechanism can move the rotary damper means in the shaft or the fixing member in a direction perpendicular to the rotation shaft, and can fix the rotary damper means to the shaft or the fixing member in the position where the rotary damper means is moved.

It is preferable that the adjusting mechanism is provided with temporally retaining means capable of temporarily retaining the rotary damper means until the rotary damper means is fixed to the shaft or the fixing member after the rotary damper means is moved. The temporally retaining means may be any appropriate temporally retaining or positioning means such as means using a positioning pin, means using attraction force of a magnet as a temporally retaining force, and means in which one of them is formed with a plurality of ratchet-like recesses and projections, and the other one of them is formed with engaging portions which are engaged with the recesses and projections, and they are temporarily retained by engaging the engaging portions with the recesses and the projections.

It is preferable that the adjusting mechanism is formed on an upper portion of the floor on which the operating lever support body is mounted. With this configuration, the adjusting mechanism can be exposed from the floor, the rotation center of the rotary damper means can easily be offset from the rotation center of the shaft on the floor. Further, it is possible to easily adjust a resistance force applied from the rotary damper means to the operating lever to a value suitable for the sensibility of an operator on the floor. Furthermore, maintenance and checking operation of the rotary damper means can be carried out on the floor, and maintenance operation is facilitated.

BEST MODE FOR CARRYING OUT THE INVENTION

Operating lever devices according to preferred embodiments of the present invention will be explained concretely below based on the accompanying drawings on the bases of an example in which the operating lever device is used for a hydraulic switching valve in construction equipment such as a hydraulic shovel. The operating lever device of the invention is not limited to those described in the following embodiments, and the operating lever device can also be applied to various modes only if a resistance force from rotary damper means can be applied to an operating lever.

First Embodiment

Figure 1:
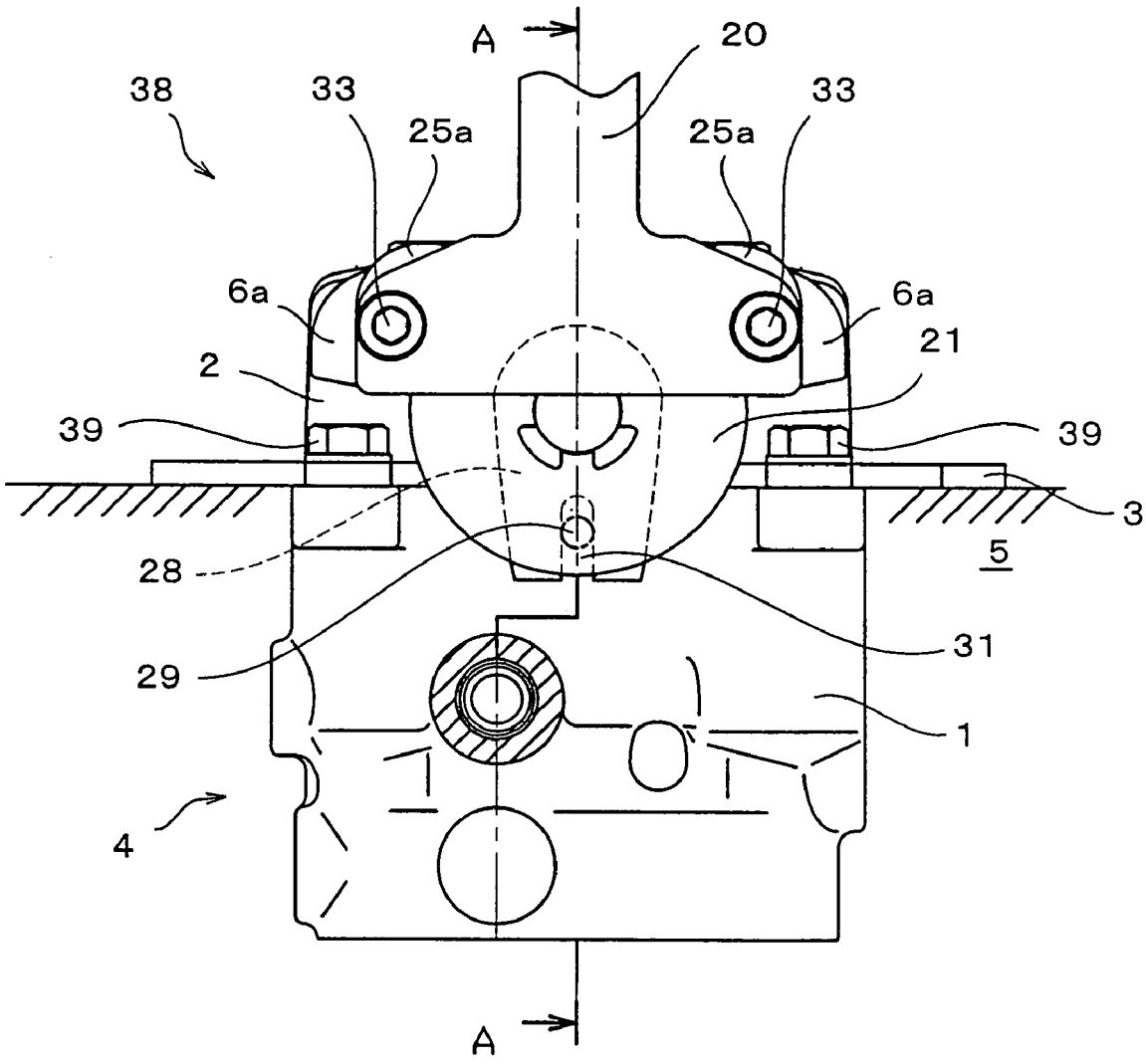
FIG. 1 is a side view of an operating lever device and a valve body mounted on the operating lever device showing an embodiment of the present invention (first embodiment).
Figure 2:
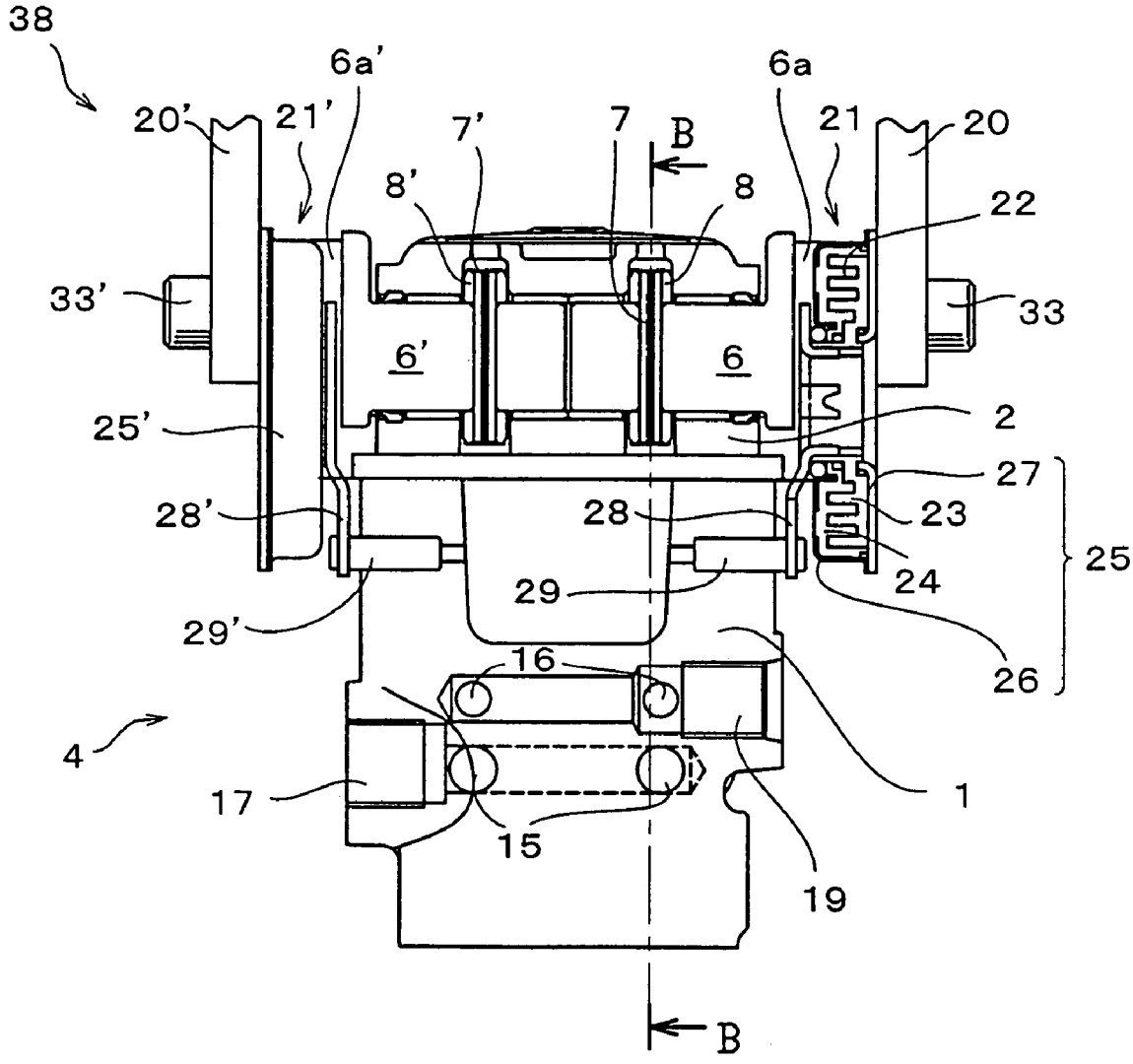
FIG. 2 is a sectional view taken along the line A-A in FIG. 1 (first embodiment).
Figure 4:
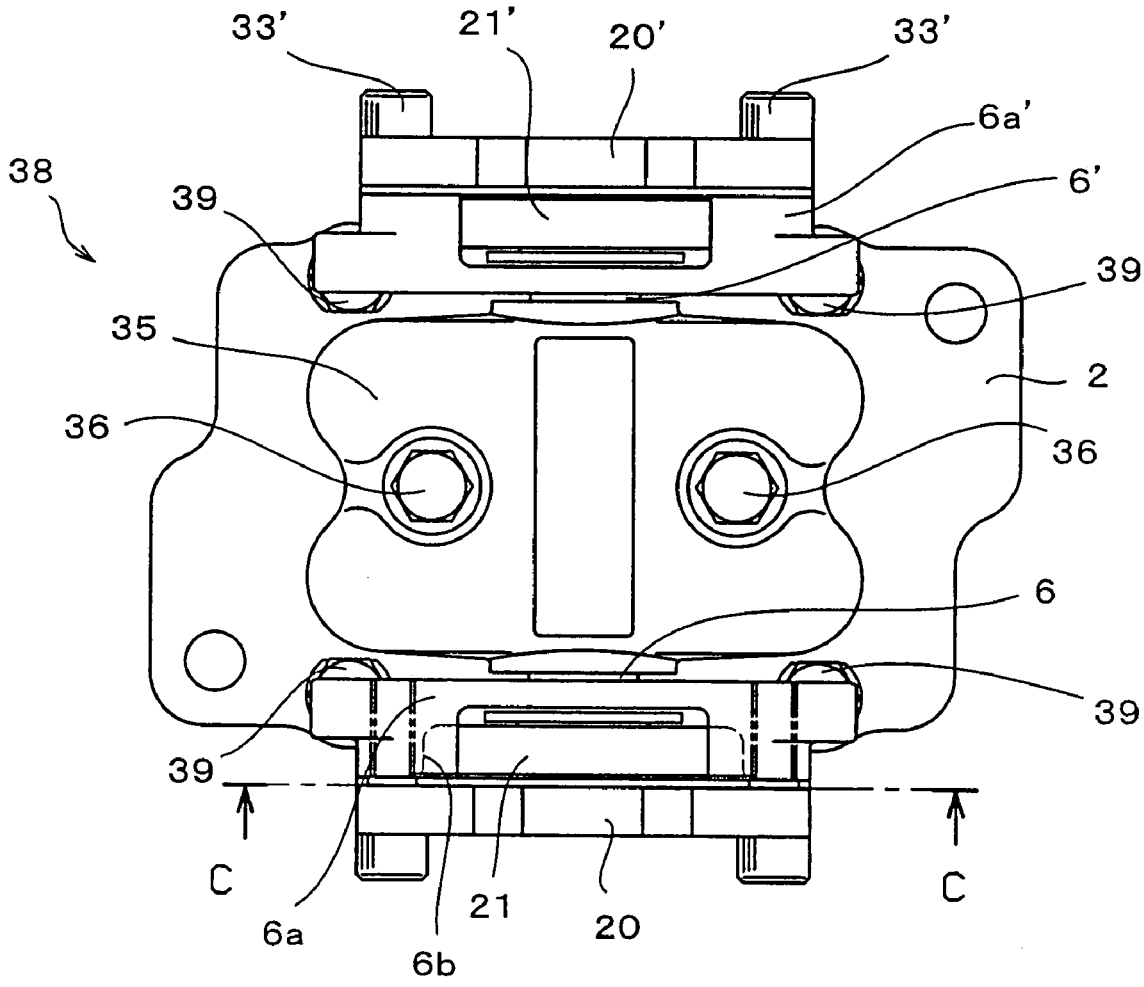
FIG. 4 is a plan view of the operating lever device (first embodiment).

As shown in FIG. 1, an operating lever device 38 is provided on a floor 5 of a driver's room or the like in construction machinery. The operating lever device 38 is fixed on the floor 5 through a plate 3 by bolts 39. As shown in FIGS. 2 and 4, the operating lever device 38 comprises a pair of left and right operating levers 20 and 20', a pair of left and right rotary damper means 21 and 21', a pair of left and right shafts 6 and 6', a pair of left and right flange portions 6*a* and 6'*a* formed on the shafts 6 and 6', and a shaft support body 2 rotatably supporting the shafts 6 and 6'. The shaft support body 2 is mounted on a body 1 through fixing bolts 36, and a valve body 4 is accommodated in the body 1.

Figure 3:
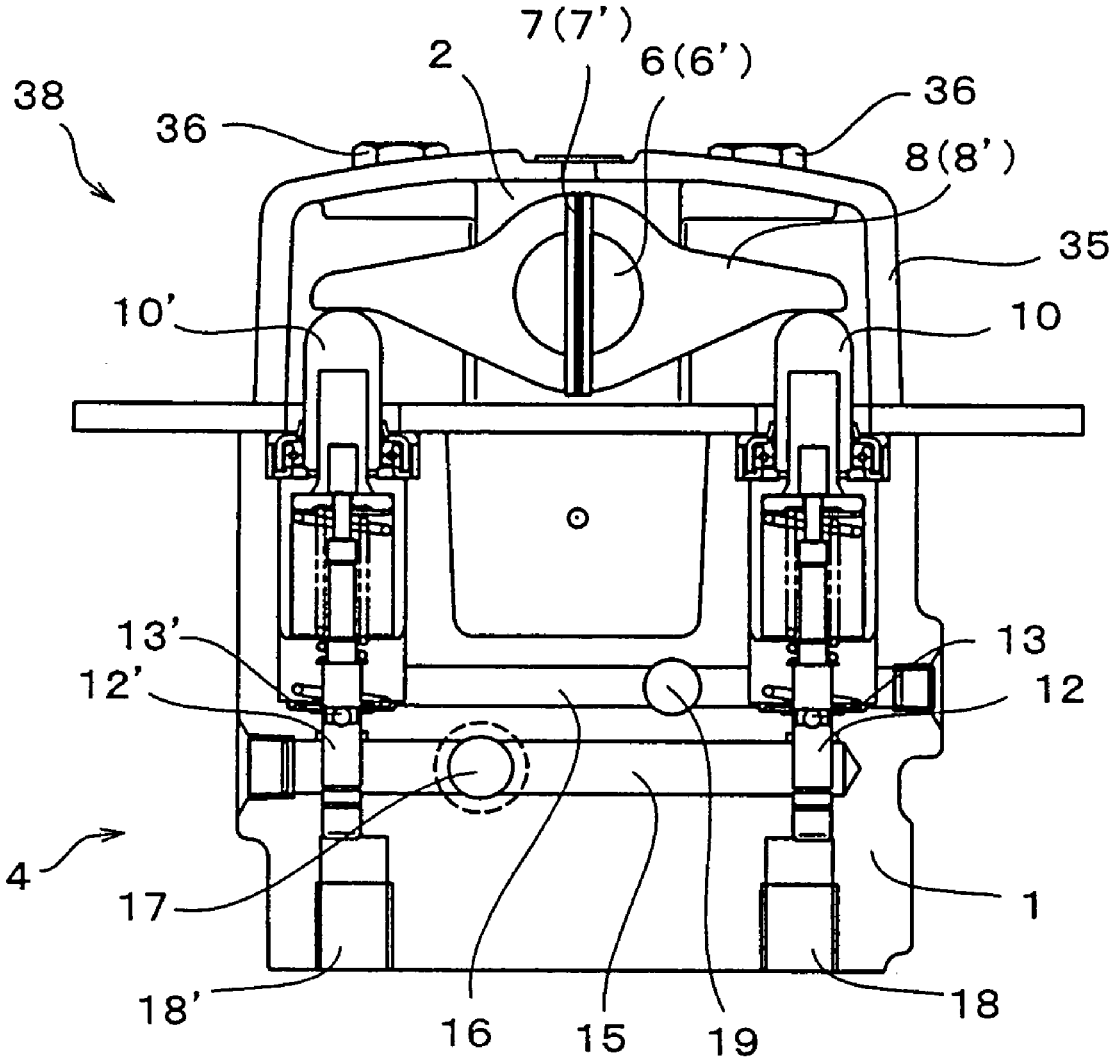
FIG. 3 is a sectional view taken along he line B-B in FIG. 2 (first embodiment).

The operating levers 20 and 20', the rotary damper means 21 and 21', the shafts 6 and 6' and the flange portions 6*a* and 6'*a* are the pair of left and right sets. The members in each set carry out the same operation by an inclining operation of the operating lever 20 or the operating lever 20'. As shown in FIG. 3, the pair of left and right switching valves accommodated in the body 1 carry out the same operation by the inclining operation of the operating lever 20 or the operating lever 20'. In the following explanation, the members in each set are not explained separately, one of the member in each set is provided with ['] after a symbol, and the other member is not provided with ['] after a symbol, thereby the members are explained.

As shown in FIGS. 2 and 3, the pair of shafts 6 and 6' are rotatably supported in the shaft support body 2 such that the shafts 6 and 6' are separated from each other laterally. The shaft support body 2 is detachably provided at its upper end with an upper cover 35 through the bolts 36. The upper cover 35 closes upper portions of cam plates 8 and 8' which are mounted on the shafts 6 and 6' through detent pins 7 and 7'.

As shown in FIG. 2, the shafts 6 and 6' extend through the shaft support body 2 in left and right directions. One ends of the shafts 6 and 6' which are opposed to each other in the axial direction are disposed in the shaft support body 2 close to each other. The other ends of the pair of shafts 6 and 6' project from left and right side surfaces of the shaft support body 2, and the projecting ends are formed with the flange portions 6*a* and 6'*a*. The rotary damper means 21 and 21' and the operating levers 20 and 20' are respectively provided through the flange portions 6*a* and 6'*a*.

The operating levers 20 and 20' are mounted on the flange portions 6*a* and 6'*a* through bolts 33 and 33', and are disposed such that rotation centers of the operating levers 20 and 20' and rotation centers of the shafts 6 and 6' agree with each other. If an operator inclines the left and right operating levers 20 and 20', the valve body 4 can be operated, and a hydraulic shovel can be operated.

If the operator inclines the operating levers 20 and 20', the shafts 6 and 6' are rotated. If the shafts 6 and 6' are rotated, cam plates 8 and 8' are turned in the clockwise direction or counterclockwise direction around the rotation shafts of the shafts 6 and 6' as shown in FIG. 3. If the cam plates 8 and 8' turn, the pistons 10 and 10' are pushed downward, and operation of spools 12 and 12' are controlled by the vertical motions of the pistons 10 and 10'.

By controlling the vertical positions of the spools 12 and 12', pressurized oil supplied from an input port 17 for example passes through fine control holes 13 and 13' formed in the spools 12 and 12' from a high pressure-side passage 15, and is output from output ports 18 and 18'. When the operating levers 20 and 20' are in neutral positions, i.e., when the levers are in a state shown in FIG. 3, the pistons 10 and 10' are in communication with a tank port 19 through a low pressure-side passage 16.

The valve body 4 shown in FIG. 3 is a pilot valve which is generally used as pilot signal output means provided on a lower surface side of the shaft support body 2. The output ports 18 and 18' of the valve body 4 are connected to a hydraulic pilot portion of a driving direction-control valve provided in an intermediate portion of a main oil hydraulic circuit (not shown) through a pilot pipe. The driving direction-control valve (not shown) is switched and controlled in accordance with pilot pressure output from the output ports 18 and 18'. With this, a flow rate of pressurized oil to be supplied to and discharged from a driving hydraulic motor (not shown) of the hydraulic shovel can variably be controlled.

The valve body 4 mounted on the lever operating apparatus of the present invention is not limited to the pilot valve. In addition, a member operated by the shafts 6 and 6' of the operating lever device is not limited to a valve. Various apparatuses can be constituted only if the function of the present invention can be exhibited, and such apparatuses can be controlled by the operating lever.

The rotary damper means 21 and 21' generates the resistance forces when the operating levers 20 and 20' are inclined. The rotary damper means 21 and 21' are mounted using the same structures and in the same manners. Thus, only one of the rotary damper means 21 will be explained, and explanation and its symbol having ['] of the other rotary damper means 21' will be omitted.

As shown in FIG. 2, the rotary damper means 21 comprises a rotor 23, the damper case 25, a fixing pin 29 fixed to the body 1, and the damper lever 28 mounted on the rotor 23. The damper case 25 comprises a first shell 26 and a second shell 27. The damper case 25 is provided therein with the rotor 23 which rotates separately from the first shell 26 and the second shell 27, and a seat 24 fixed to the first shell 26. Opposed surfaces of the rotor 23 and the seat 24 are formed with annular projections. The annular projections are superposed on each other, thereby increasing the surface areas of the opposed surfaces of the rotor 23 and the seat 24.

Viscous fluid such as highly viscous oil is charged between the rotor 23 and the seat 24 so that viscous resistance is given to the rotor 23 and the seat 24. Examples of the viscous fluid are highly viscous oil such as silicon oil, and viscous fluid such as viscous material in which rubber material is cross-linked.

The damper lever 28 is mounted on the rotor 23. A long groove 31 is formed in the damper lever 28. The long groove 31 is hooked on the fixing pin 29 fixed to the body 1. The hooking position between the fixing pin 29 and the damper lever 28 can be adjusted by changing a position where the damper case 25 is mounted on the flange portion 6*a* or a position where the fixing pin 29 is mounted on the body 1.

Figure 5:
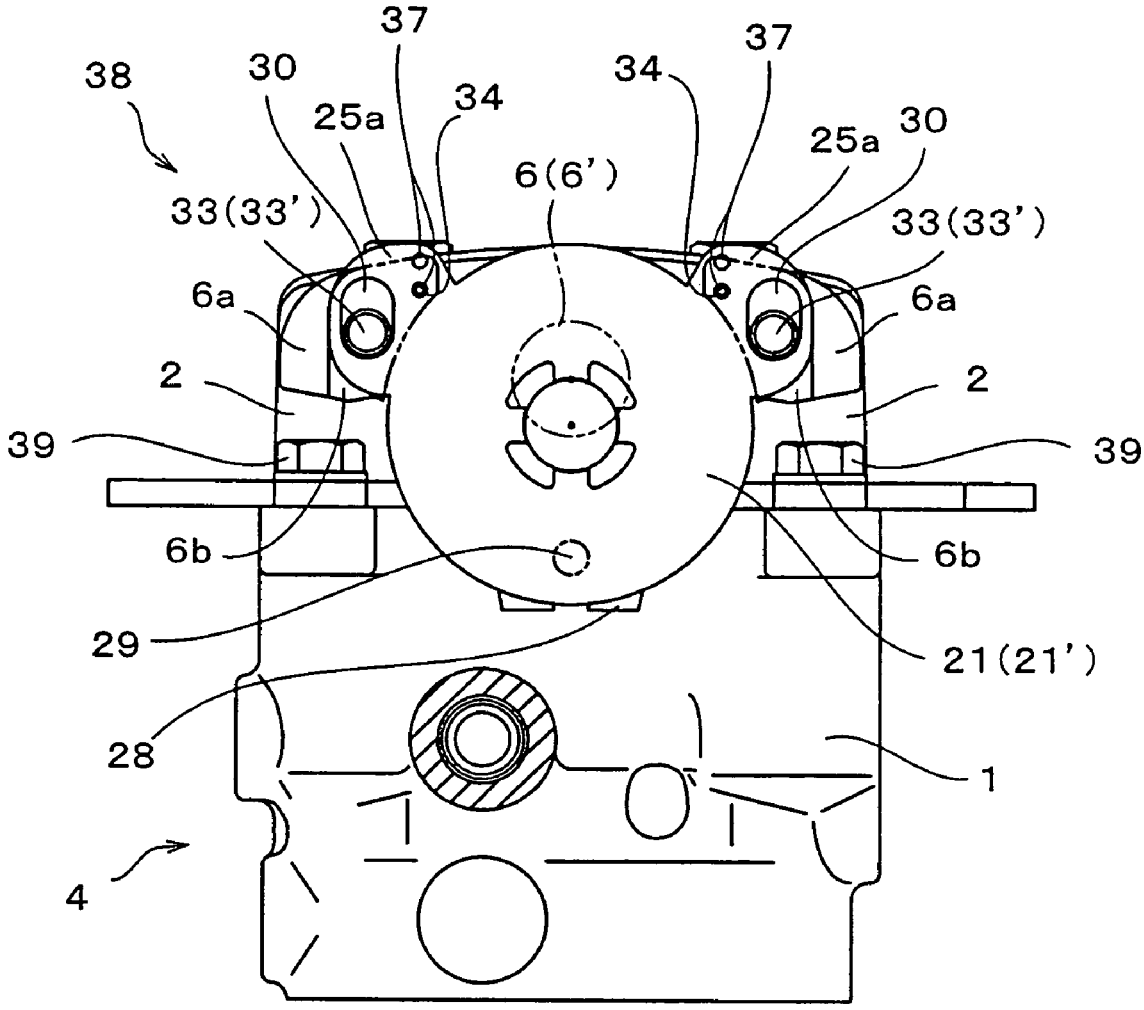
FIG. 5 is a sectional view taken along the line C-C in FIG. 4 (first embodiment).

As shown in FIGS. 1, 4 and 5, the damper case 25 and the operating lever 20 are fixed to a step 6*b* of the flange portion 6*a* through a bolt 33. The damper case 25 is fixed in a step 6*b* through a mount 25*a* formed on the damper case 25. The mount 25*a* is formed with an adjusting long groove 30. The adjusting long groove 30 is guided by the step 6*b* of the flange portion 6*a*, and is allowed to slide along the bolt 33, the bolt 33 being loosely fitted into the adjusting long groove 30 . With this, the mounting position of the damper case 25 with respect to the shaft 6 can be adjusted.

As shown in FIG. 5, a plurality of mounting positions of the damper case 25 on the flange portion 6*a* can be set by using a positioning pin 34. For example, the positioning pin 34 is fixed to one of the flange portion 6*a* and the mount 25*a* of the damper case 25, and a plurality of holes 37 are formed on the other one of the flange portion 6*a* and the mount 25*a* into which the positioning pin 34 is to be inserted.

With this configuration, if a position of the hole into which the positioning pin 34 is to be inserted is changed, the displacement amount between the rotation center of the rotary damper means 21 and the rotation center of the shaft 6 can be adjusted in such multiple stages that corresponds to the number of formed holes. If the positioning pin 34 is used, the damper case 25 can be temporarily positioned with respect to the flange portion 6*a*. By the temporarily positioning using the positioning pin 34, it is possible to prevent the mounting position of the damper case 25 on the flange portion 6*a* from moving before it is fixed using the bolt 33.

In FIG. 5, two holes 37 are formed on each of left and right sides, but the number of the holes 37 is not limited to two, and a plurality of holes 37 may be formed. The positioning means is not limited to means using the positioning pin. If a magnet is mounted on one of the flange portion 6*a* and the mount 25*a* and a magnetic material is mounted on the other one of them, it is possible to position the damper case 25 using the magnetic force. Alternatively, if a ratchet groove is formed in one of the flange portion 6*a* and the mount 25*a* and an engaging portion which engages with the ratchet groove is formed on the other one of them, the damper case 25 can be positioned. Further, if a measure is formed in one of the flange portion 6*a* and the mount 25*a* and a thin groove for checking a measure position is formed on the other one of them, the damper case 25 can be positioned. Positioning could be done by using other appropriate positioning means.

Figure 6:
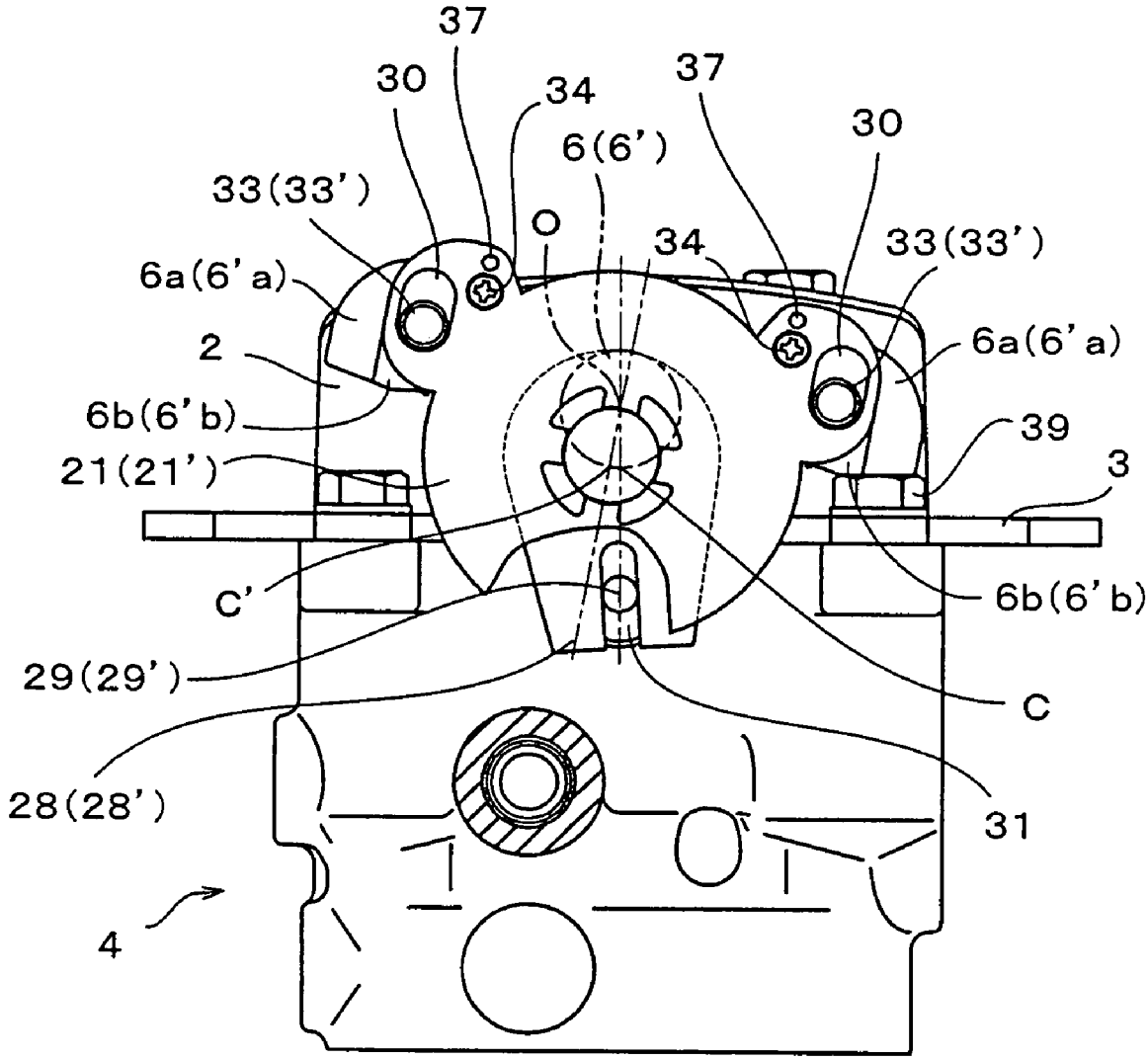
FIG. 6 is a side view of the valve body when an operating lever is inclined (first embodiment).

As shown in FIG. 6, the shaft 6 rotates by the inclining operation of the operating lever 20. At that time, the rotary damper means 21 turns around the rotation center O of the operating lever 20. The damper case 25 turns together with the flange portion 6*a* but the turning motion of the damper lever 28 on which the rotor 23 is mounted is limited by the fixing pin 29. The damper lever 28 and the damper case 25 rotate relatively.

Namely, the rotor 23 and the damper case 25 relatively rotate. With this, relative rotation is generated between the rotor 23 and the seat 24 which rotates in unison with the damper case 25, and they rotate relatively while receiving resistance of the viscous fluid filled into the damper chamber 22 (22'). The resistance generated at that time becomes the resistance force applied to the operating lever 20 from the rotary damper means 21.

Although the damper lever 28 is mounted on the rotor 23 and the damper case 25 is mounted on the shaft 6 in the above explanation, it is also possible to mount the rotor 23 on the shaft 6 and to mount the damper lever 28 on the damper case 25.

When the rotation center of the rotary damper means 21 is deviated from the rotation center of the shaft 6, a resistance force can be applied to the operating lever 20 from the rotary damper means 21. This will be explained next. First, a resistance force which can be applied from the rotary damper means 21 to the operating lever 20 when the rotation center of the rotary damper means 21 and the rotation center of the shaft 6 correspond to each other will be explained using FIG. 8. With the configuration of the present invention, the resistance force that can be applied to the operating lever 20 from the rotary damper means 21 can be increased and reduced. This will be explained next using FIG. 9.

Figure 8:
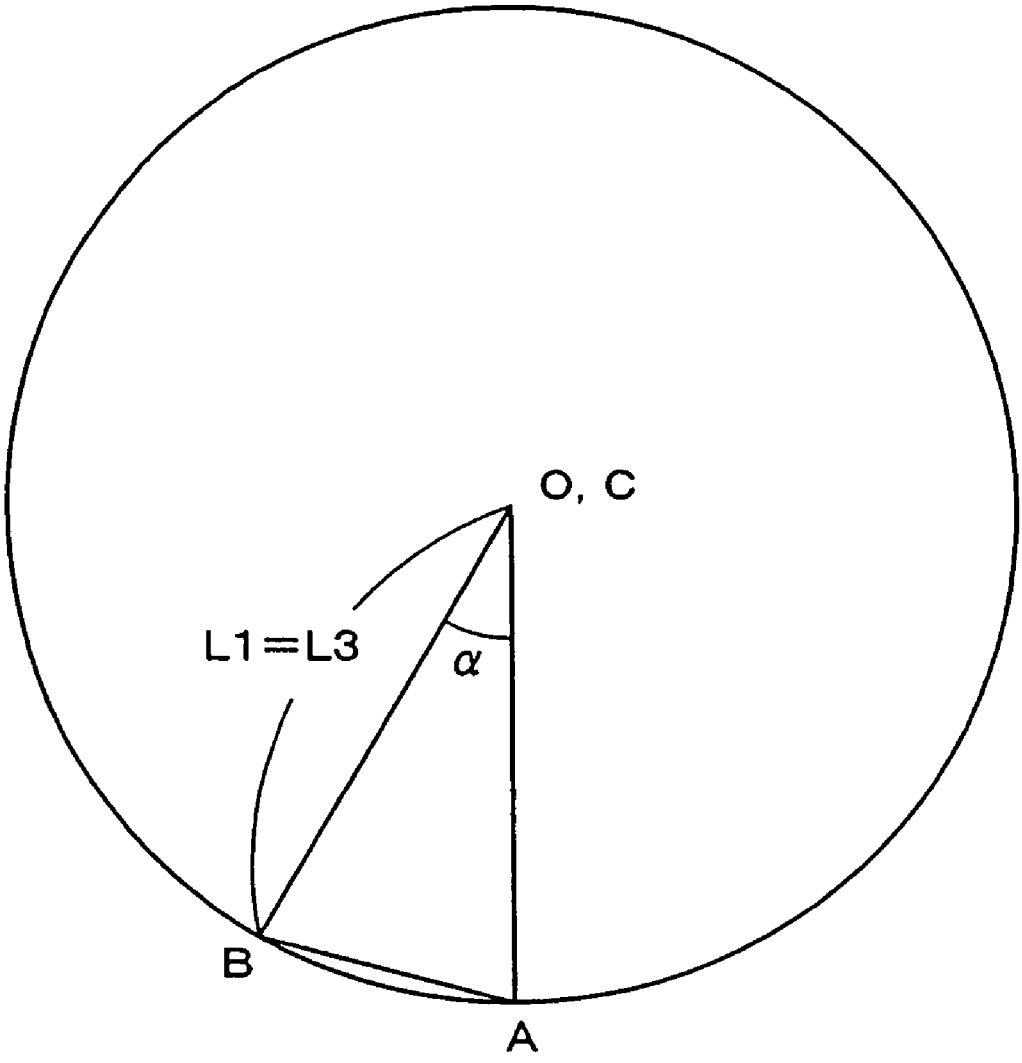
FIG. 8 PRIOR ART
FIG. 8 is an explanatory view of operation of rotary damper means (prior art).
Figure 9:
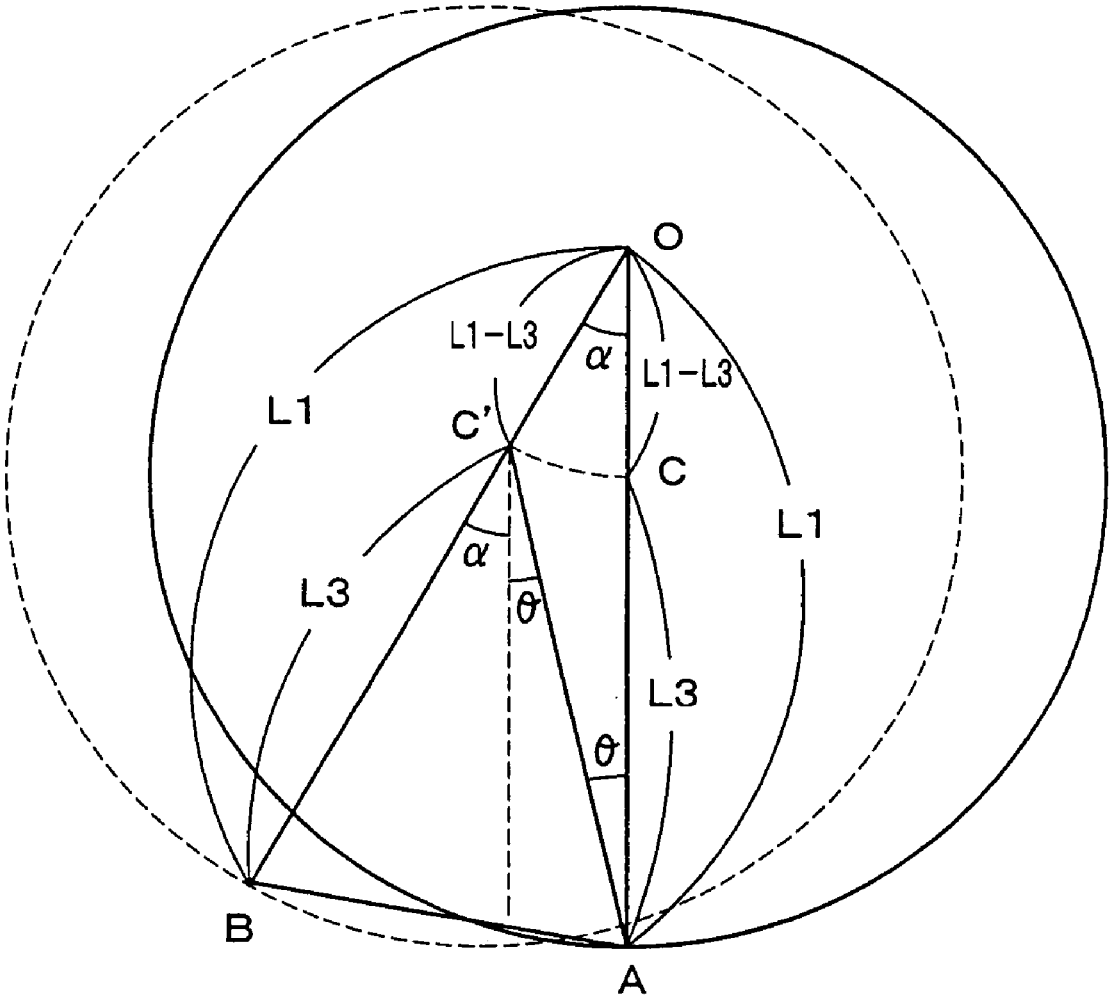
FIG. 9 is an explanatory view of operation the rotary damper means (first embodiment).
Figure 10:
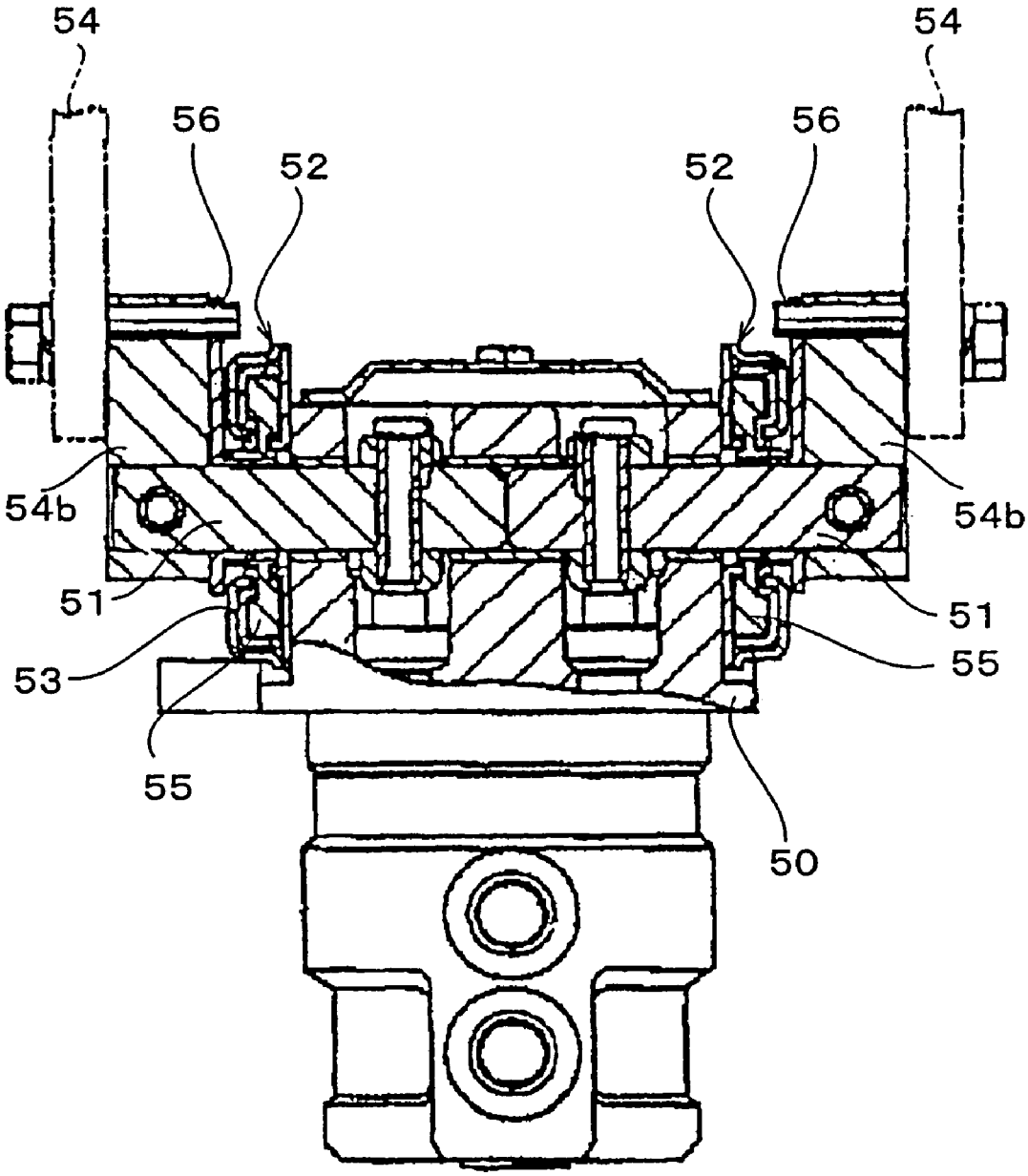
FIG. 10 PRIOR ART
FIG. 10 is a sectional view of the operating lever device (prior art).

FIG. 8 is an explanatory view when the rotation center C of the rotary damper means and the rotation center O of the shaft correspond to each other like the case of the patent document 1. FIG. 9 is an explanatory view when the rotation center C of the rotary damper means 21 and the rotation center O of the shaft in the operating lever device of the present invention are deviated from each other.

In FIGS. 8 and 9, to simplify the explanation, it is assumed that the damper case 25 is fixed to the shaft 6, the rotor 23 is mounted on the damper lever 28, and the long groove 31 formed in the end of the damper lever 28 is hooked on the fixing pin 29 as explained in the embodiment of the invention.

In both FIGS. 8 and 9, the position of the fixing pin 29 which hooks the damper case 25 is shown with A. A phantom rotation position or turning position of the fixing pin 29 is defined as B when it is assumed that as the shaft 6 is rotated by the inclining operation of the operating lever 20, the damper case 25 and the fixing pin 29 also rotate or turn in unison with each other together with the shaft 6. That is, the phantom moving position of the fixing pin 29 when the shaft 6 rotates or turns through an angle $\alpha$ and the fixing pin 29 rotates or turns through the angle $\alpha$ around the rotation center O of the shaft 6 is defined as B.

In FIG. 8, the damper case 25 rotates together with the shaft 6 around the rotation shaft of the shaft 6 through the angle $\alpha$ by the inclining operation of the operating lever 20. Even if the damper case 25 rotates through the angle $\alpha$, the rotor 23 is prevented from rotated by the fixing pin 29 and by the hooking state between the fixing pin 29 and the long groove 31 of the damper lever 28. Thus, the rotor 23 relatively rotates to the damper case 25 only through the angle $\alpha$.

With this, a relative rotation angle difference is generated between the rotor 23 and the seat 24 in the rotary damper means 21 by the rotation angle $\alpha$ caused by the rotation of the shaft 6. Therefore, while the operating lever 20 is inclined through the range of angle $\alpha$, the operating lever 20 receives the resistance force from the rotary damper means 21.

Next, FIG. 9 will be explained. In FIG. 9, the solid line circle is a circle whose center is on the rotation center C of the rotary damper means 21 and whose radius is equal to a distance L3 of a line segment between a point C and a point A. The dotted circle is a circle whose center is on a point C' which is a rotation center of the rotary damper means 21 moving from a point C, and whose radius is L3. A distance between the rotation center O of the shaft 6 and the fixing pin 29 in claim 3 of this application is L1, and a distance from the rotation center C of the rotary damper means to the position A of the fixing pin is L3.

In FIG. 9, the shaft 6 rotates by the inclining operation of the operating lever 20, and the damper case 25 turns around the rotation center O of the shaft 6. Regardless of the rotation of the damper case 25, the rotor 23 is prevented from rotating by the fixing pin 29 due to the hooked state between the fixing pin 29 and the long groove 31 of the damper lever 28. At that time, the rotor 23 and the seat 24 relatively rotate through an angle $\alpha+\Theta$.

The relative rotation of the angle $\alpha+\Theta$ between the rotor 23 and the seat 24 will be explained below. As shown in FIG. 9, when the rotation center C of the rotary damper means 21 is provided to be deviated from the rotation center O of the shaft 6, if the shaft 6 rotates by the operating lever 20 through the angle $\alpha$, the rotation center C of the rotary damper means 21 turns to the point C', centering around the point O that is the rotation center of the shaft 6.

At that time, if it is assumed that the fixing pin 29 also turns together with the rotary damper means 21, it can be assumed that the fixing pin moves to a point B that is an intersection between the dotted line circle and a line segment passing through the point C' from the point O. However, the fixing pin 29 is fixed and does not move in the actual case, the rotor 23 rotates relative to the damper case 25 (seat 24) through the angle $\alpha+\Theta$ of BC'A of a triangle ABC'.

Here, when the length from the rotation center O of the shaft 6 to the point A that is the position of the fixing pin 29 is defined as L1, regarding a triangle OC'A is conceived. The angle of C'OA is a, and the angle of C'AO is $\Theta$. In the triangle OC'A, the height of the triangle OC'A when a side OA is defined as a base can be expressed as follows by means of trigonometric functions using the angle a and the angle $\Theta$:

Here, r=L1−L3.

$$r\cdot\sin\alpha=(L1-r\cdot\cos\alpha)\cdot\tan\Theta$$

From this equation and from r=L1−L3, the following equation can be obtained:

$$\tan\Theta=(L1-L3)\cdot\sin\alpha/(L1-(L1-L3)\cdot\cos\alpha)$$

Here, it is assumed that the angle $\alpha$ and the angle $\Theta$ are small values close to zero. Here, $\tan\Theta=\Theta$, $\sin\alpha=a$ and $\cos a=1$, and if these relation equations are substituted into the above equation, the following equation can be obtained:

$$\Theta=(L1-L3)\cdot a/(L1-L1+L3).$$

This can be expressed as follows:

$$\Theta=(L1-L3)\cdot a/L3.$$

With this, the relative rotation angle with respect to the damper case 25 (seat 24) of the rotor 23 is $\Theta+\alpha$. If the value of $\Theta+\alpha$ is obtained from the above equation, $\Theta+\alpha=(L1/L3)\cdot\alpha$. It is possible to generate a resistance force which is L1/L3 times greater than that of the rotary damper means 21 of the case shown in FIG. 8.

In this invention, by deviating the rotation center of the rotary damper means from the rotation center of the shaft, the resistance force can be increased and reduced and can be applied to the operating lever as compared with that of the conventional example. When the resistance force is reduced as compared with that of the conventional example, the rotary damper means is deviated to a position where the distance L3 between the fixing pin and the rotation center of the rotary damper means becomes longer than the distance L1 from the rotation center of the shaft to the fixing pin, and the rotary damper means is mounted on the flange portion of the shaft. With this, a resistance force smaller than that of the conventional example can be generated in the rotary damper means.

If the ratio of deviation of the rotation center of the rotary damper means from the rotation center of the shaft is changed, it is possible to increase or reduce the resistance force to be applied from the rotary damper means to the operating lever and variably adjust the resistance force. It is possible to change the length between the distance L1 and the distance L3 by adjusting the hooking position between the fixing pin 29 and the damper lever 28, and the value L1/L3 can be changed. It is also possible to change the resistance force applied from the rotary damper means to the operating lever also by adjusting the hooking position between the fixing pin 9 and the damper lever.

With this, it is possible to apply a resistance force in accordance with the sensibility of an operator at the time of the inclining operation of the operating lever. As the configuration of the shaft support body which rotatably supports the shaft, the operating lever may directly supported rotatably, or the shaft may be rotatably supported by the shaft support body and the operating lever may be mounted on the shaft, or the shaft and the operating lever may be integrally formed.

Second Embodiment

Figure 7:
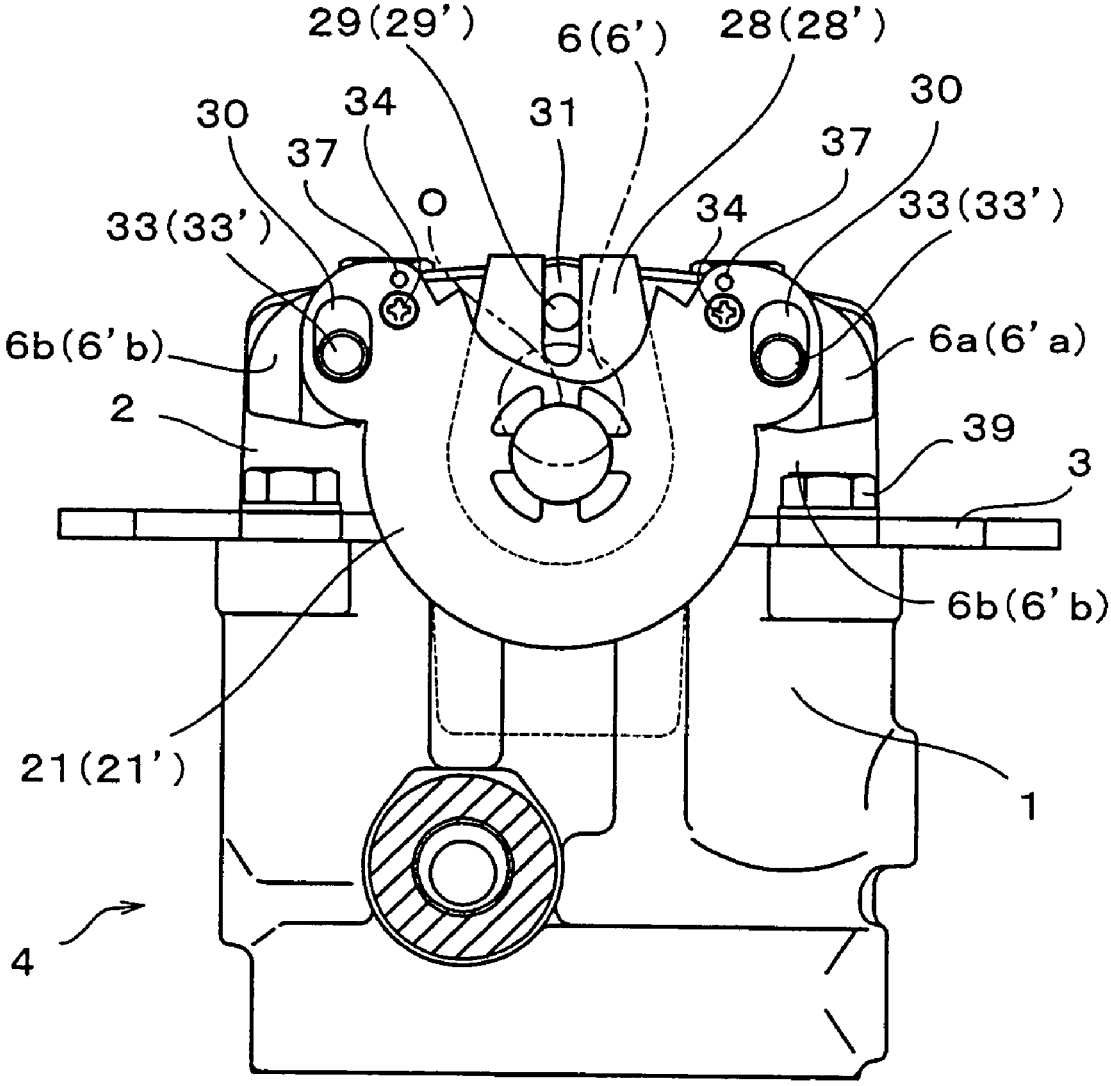
FIG. 7 is a side view of the valve body showing a modification of position where a fixing pin is disposed (second embodiment).

FIG. 7 shows second embodiment of the present invention. The second embodiment is the same structure as the first embodiment except that the fixing pin 29 is located above the shaft 6. The effect as the operating lever device of the second embodiment is also the same as that of the operating lever device of the first embodiment. Therefore, in the second embodiment, the same members as those of the first embodiment are used, and explanation of the member will be omitted. A structure of the second embodiment that is different from the first embodiment will mainly be explained below.

As shown in FIG. 7, fixing pins 29 and 29' are disposed above the shafts 6 and 6'. Since the fixing pins 29 and 29' are disposed above the shafts 6 and 6', the long grooves 31 of the damper levers 28 and 28' are disposed to be directed upward.

With this configuration, the fixing pins 29 and 29' can be exposed from the floor on which the operating lever device is mounted. Further, the mounting operation of the plurality of fixing pins 29 and 29' formed on the body of the operating lever device with respect to the mounting holes to which the fixing pins 29 and 29' are to be mounted can be carried out on the floor.

Especially since multiple hooking locations between the fixing pins 29 and 29' and the long grooves 31 of the damper levers 28 and 28' can be set on the floor, it is possible to easily adjust a resistance force in the rotary damper means 21 and 21.

INDUSTRIAL APPLICABILITY

The techniques of the present invention can be applied to various apparatuses which can be operated by an inclining operation of an operating lever and which need to apply a desired resistance force to the operating lever.

The invention claimed is:

1. An operating lever device comprising:

a shaft which is rotated in unison with an operating lever by inclining operation of the operating lever;

a shaft support body which rotatably supports the shaft; and a rotary damper device which generates rotation resistance at the time of the inclining operation of the operating lever, wherein the rotary damper device includes:

a damper case having an annular damper chamber for accommodating viscous fluid therein;

a rotor which rotates against the viscous fluid in the damper chamber, a fixing pin mounted on a body of the operating lever device, and a damper lever fixed to one of the damper case and the rotor, wherein a rotation center of the rotary damper device and a rotation center of the shaft are deviated from each other, the other of the damper case and the rotor is mounted on the shaft, and the damper lever is hooked on the fixing pin.

2. The operating lever device according to claim 1, wherein a hooking position between the fixing pin and the damper lever can be adjusted.

3. The operating lever device according to claim 2, wherein the operating lever device comprises an adjusting mechanism which adjusts a ratio between a distance from the rotation center of the shaft to the fixing pin, and a distance from the rotation center of the rotary damper device to the fixing pin, wherein the adjusting mechanism is configured such that a mount provided on the damper case or the rotor can be mounted on plural mounting positions relatively with respect to the shaft, and the plural mounting positions are configured as plural positions which make the rotation center of the rotary damper device separated from a line connecting the rotation center of the shaft with the fixing pin.

4. The operating lever device according to claim 3, wherein the mount and each of mounting portions of the shaft, on which the mount is mounted, are disposed on an upper portion of a floor on which the shaft support body is mounted.

* * * * *

UNITED STATES PATENT AND TRADEMARK OFFICE

CERTIFICATE OF CORRECTION

PATENT NO. : 7,644,641 B2
APPLICATION NO. : 10/573055
DATED : January 12, 2010
INVENTOR(S) : Mototani et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 867 days.

Signed and Sealed this

Twenty-first Day of December, 2010

David J. Kappos

David J. Kappos
*Director of the United States Patent and Trademark Office*